US006687958B2

(12) United States Patent
Wurst

(10) Patent No.: US 6,687,958 B2
(45) Date of Patent: Feb. 10, 2004

(54) CARDING MACHINE

(75) Inventor: Gerhard Wurst, Geislingen (DE)

(73) Assignee: Hollingsworth GmbH (DE)

( * ) Notice: Subject to any disclaimer, the term of this patent is extended or adjusted under 35 U.S.C. 154(b) by 0 days.

(21) Appl. No.: 10/133,349

(22) Filed: Apr. 29, 2002

(65) Prior Publication Data

US 2002/0112321 A1 Aug. 22, 2002

Related U.S. Application Data

(63) Continuation of application No. 09/785,520, filed on Feb. 20, 2001.

(30) Foreign Application Priority Data

Feb. 17, 2000 (DE) ..... 100 07 268

(51) Int. Cl.[7] ..... D01G 15/00
(52) U.S. Cl. ..... 19/98; 19/113; 19/114
(58) Field of Search ..... 19/98, 102, 104, 19/105, 110, 111, 113, 114

(56) References Cited

U.S. PATENT DOCUMENTS

| | | | |
|---|---|---|---|
| 397,265 | A | 2/1889 | Ashworth et al. |
| 564,052 | A | 7/1896 | Deiss |
| 575,986 | A | 1/1897 | Potter |
| 693,817 | A | 2/1902 | Mills et al. |
| 896,023 | A | 8/1908 | Kasparson |
| 1,709,038 | A | 4/1929 | Platt |
| 3,737,953 | A | 6/1973 | Bechtel, Jr. |
| 3,793,677 | A | 2/1974 | Bechtel, Jr. |
| 3,808,640 | A | 5/1974 | Graf |
| 3,936,911 | A | 2/1976 | Roberts |
| 4,074,392 | A | 2/1978 | Bechtel, Jr. |
| 4,221,023 | A | 9/1980 | Henderson et al. |
| 4,295,248 | A | 10/1981 | Beneke et al. |
| 4,297,768 | A | 11/1981 | Loffler |
| 4,513,480 | A | 4/1985 | Bisquolm et al. |
| 4,528,724 | A | 7/1985 | Bisquolm |
| 4,553,288 | A | 11/1985 | Schneider et al. |
| 4,893,380 | A | 1/1990 | Graf |
| 5,095,585 | A | 3/1992 | Grimshaw et al. |
| 5,467,505 | A | 11/1995 | Graf |
| 5,755,012 | A | 5/1998 | Hollingsworth |
| 5,898,978 | A | 5/1999 | Hollingsworth |
| 6,101,680 | A | 8/2000 | Naf et al. |

FOREIGN PATENT DOCUMENTS

| | | |
|---|---|---|
| EP | 0 887 445 | 12/1989 |
| GB | 2 100 305 | 12/1982 |

*Primary Examiner*—Gary L. Welch
(74) *Attorney, Agent, or Firm*—Cantor Colburn LLP

(57) ABSTRACT

An arrangement for a carding machine for parallel arrangement of fibers, includes a carding track; a plurality of flat bars arranged for being guided along the carding track; clothing positioned respectively on each flat bar, the clothing including clothing structure that engages in the fibers; and a mechanism for releaseably fastening the clothing to each flat bar.

19 Claims, 4 Drawing Sheets

CARDING MACHINE

CROSS-REFERENCE TO RELATED APPLICATIONS

Priority is claimed with respect to Application No. 100 07 268.2-26 filed in Germany on Feb. 17, 2000, the disclosure of which is incorporated herein by reference. This is a continuation of Ser. No. 09/785,520 filed Feb. 20, 2001 and incorporated herein by reference.

BACKGROUND OF THE INVENTION

The invention relates to a carding machine for the parallel arrangement of fibers by clothing guided along a carding track and having combing structures that engage in the fibers.

A carding machine of this type is used for the parallel alignment of fibers, in particular cotton fibers. The fibers are transported in bundles to a main carding cylinder in the shape of a cylindrical roller which is horizontally positioned. The fiber bundles are aligned in the circumferential direction of the main carding cylinder while positioned on the surface of the carding cylinder along the longitudinal length thereof.

Specifically, the fibers are transported in the circumferential direction on the main carding cylinder and engage in clothing fitted onto a carding track and guided over a cylinder arrangement. The clothing consists of individual flexible material strips with combing structures in the form of metal needles on the top.

The clothing extends in the longitudinal direction of the main carding cylinder, directly above its surface, so that the fibers are combed with these combing structures and are aligned in the circumferential direction of the main carding cylinder.

The clothing is fastened to respective flat bars guided along the carding track on the carding machine, wherein the dimensions of the flat bars are adapted to the dimensions of the clothing.

With known carding machines, the clothing rests on top of the flat bars. The flat bars are wider at the upper end and have a rectangular cross-sectional profile, wherein the clothing rests on the complete upper front of the profile. Parts made of sheet metal or the like are attached to the side walls of the flat bars for reinforcement. These parts project slightly over the upper edge of the profile with the clothing, as well as over the lower edge of the profile. The projecting ends of the sheet metal parts are bent through beading, so that they fit against the top and bottom side of the profiles and thus secure the respective clothing on a profile.

The individual clothing is subject to relatively high wear and thus must be exchanged within a predetermined time interval. The clothing is removed for replacement from the carding machine, along with the fixedly attached flat bars. Subsequently, the clothing assembly is mechanically treated in a machine shop or servicing station in order to separate the clothing secured with the beading on the flat bars from these flat bars. New clothing is then attached to the flat bars and secured in place through beading of the sheet metal parts affixed to the side.

The disadvantage of this type of arrangement is that the assembly for replacing the clothing is extremely involved. Particularly disadvantageous is the fact that changing the clothing requires corresponding mechanical tools, so that the replacement cannot be made at the location of the carding machine, but must be made in a machine shop or servicing station. Thus, the replacement of clothing not only requires considerable time for the assembly, but also results in a considerable expenditure due to transport time and transport costs.

SUMMARY OF THE INVENTION

It is an object of this invention to provide a carding machine of the aforementioned type in such a way that the replacement of clothing is made as simple as possible.

The above and other objects are accomplished according to the invention by the provision of an arrangement for a carding machine for parallel arrangement of fibers, including: a carding track; a plurality of flat bars arranged for being guided along the carding track; clothing positioned respectively on each flat bar, the clothing including clothing structure that engages in the fibers; and means for releaseably fastening the clothing to each flat bar.

The essential advantage of fastening the clothing in this way to the flat bars is that the clothing can be fastened and repeatedly released by using simple tools. The clothing can therefore be replaced easily and quickly at the location of the carding machine. It is particularly advantageous in this case that the fastening mechanism can be attached to the flat bars, and can be reversibly detached or released so that the mechanism can be reused after the clothing has been replaced.

The clothing of one particularly advantageous embodiment of the invention is attached to a rigid base support, for example a sheet metal part.

The sheet metal part with attached clothing forms a stable structural unit that can be mounted flexibly and easily to a flat bar. In particular the flexible clothing is protected in that case against mechanical damage or being pulled out of shape. Furthermore, it is advantageous that the dimensionally stable structural unit, consisting of base support and clothing, can be positioned easily and safely on the flat bar, thus making it easier to attach to the flat bar.

According to one preferred embodiment, brackets are used as means for securing the clothing to a flat bar. In that case, the clothing with base support is positioned on the top front of the flat bar. The brackets are then fitted from the side onto the flat bar and the clothing that rests on top.

The fastening means for another advantageous embodiment are guides in the flat bars, into which the clothing secured on the base support can be inserted.

BRIEF DESCRIPTION OF THE DRAWINGS

The invention is explained in the following with the aid of the accompanying drawings.

DETAILED DESCRIPTION OF THE INVENTION

Figure 1:
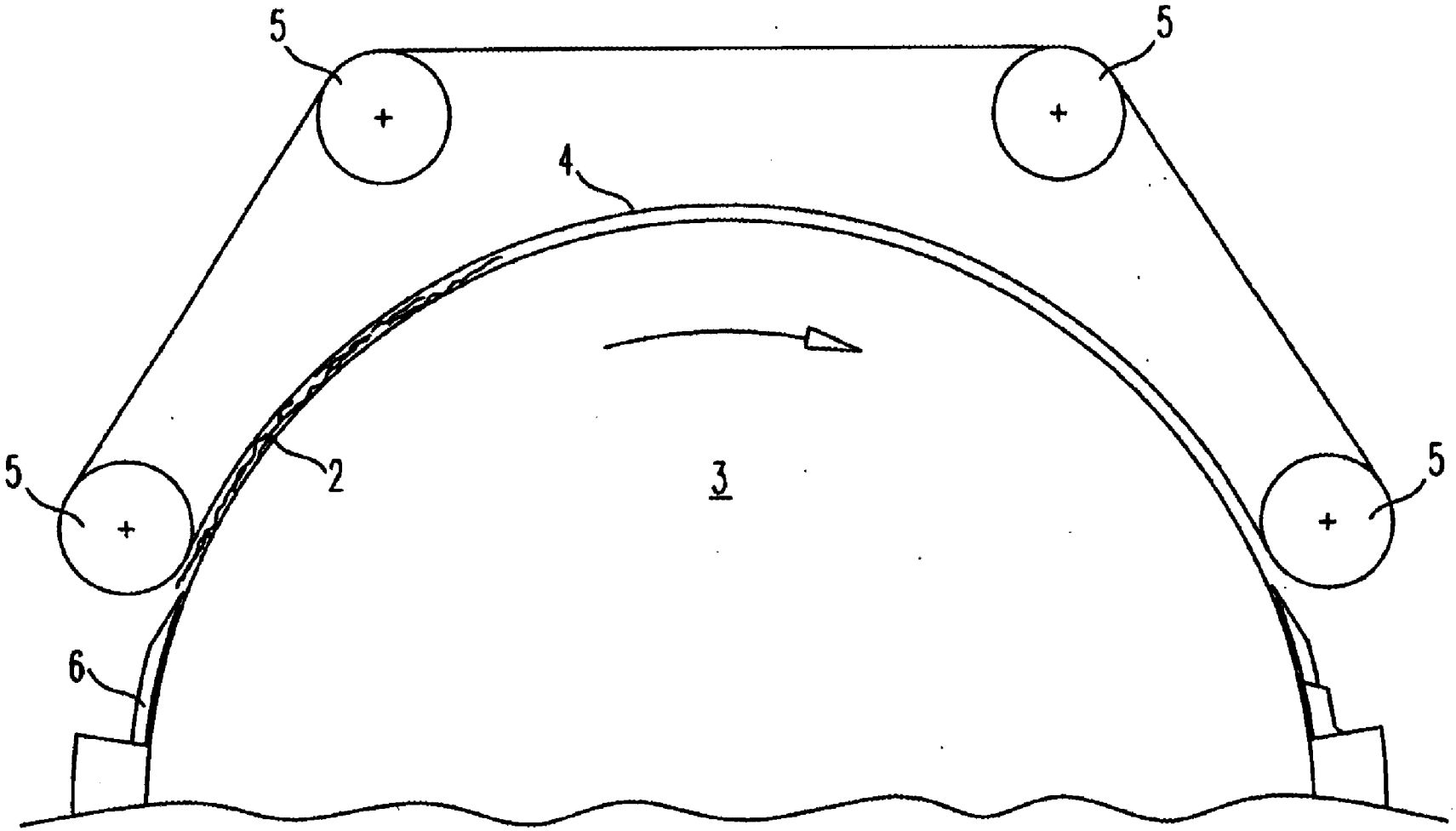
FIG. 1 is a schematic representation of an end view of a carding machine for the parallel arrangement of fibers.

FIG. 1 shows an exemplary embodiment of a carding machine 1 for the parallel alignment of fibers 2, in particular cotton fibers.

The carding machine 1 comprises a main carding cylinder 3 in the shape of a cylindrical roller, for which the longitudinal axis is positioned horizontally. The main carding cylinder 3 is positioned so as to rotate around a rotational axis that extends in the longitudinal direction and is made to rotate by means of non-depicted drives.

A carding track 4 that is driven by a system of rollers 5 adjoins the top of the surface of main carding cylinder 3. The rollers 5 are arranged such that the carding track 4 is guided at a short distance from the surface, via an angular section of nearly 180°, wherein the carding track extends in the circumferential direction of the main carding cylinder 3.

The fibers 2 are fed to the main carding cylinder 3 with the aid of an insertion device with insertion fitting or shoe 6. The fibers 2 are guided as fiber bundles in the circumferential direction, while resting on the surface and in the longitudinal direction of the main carding cylinder 3.

Figure 2:
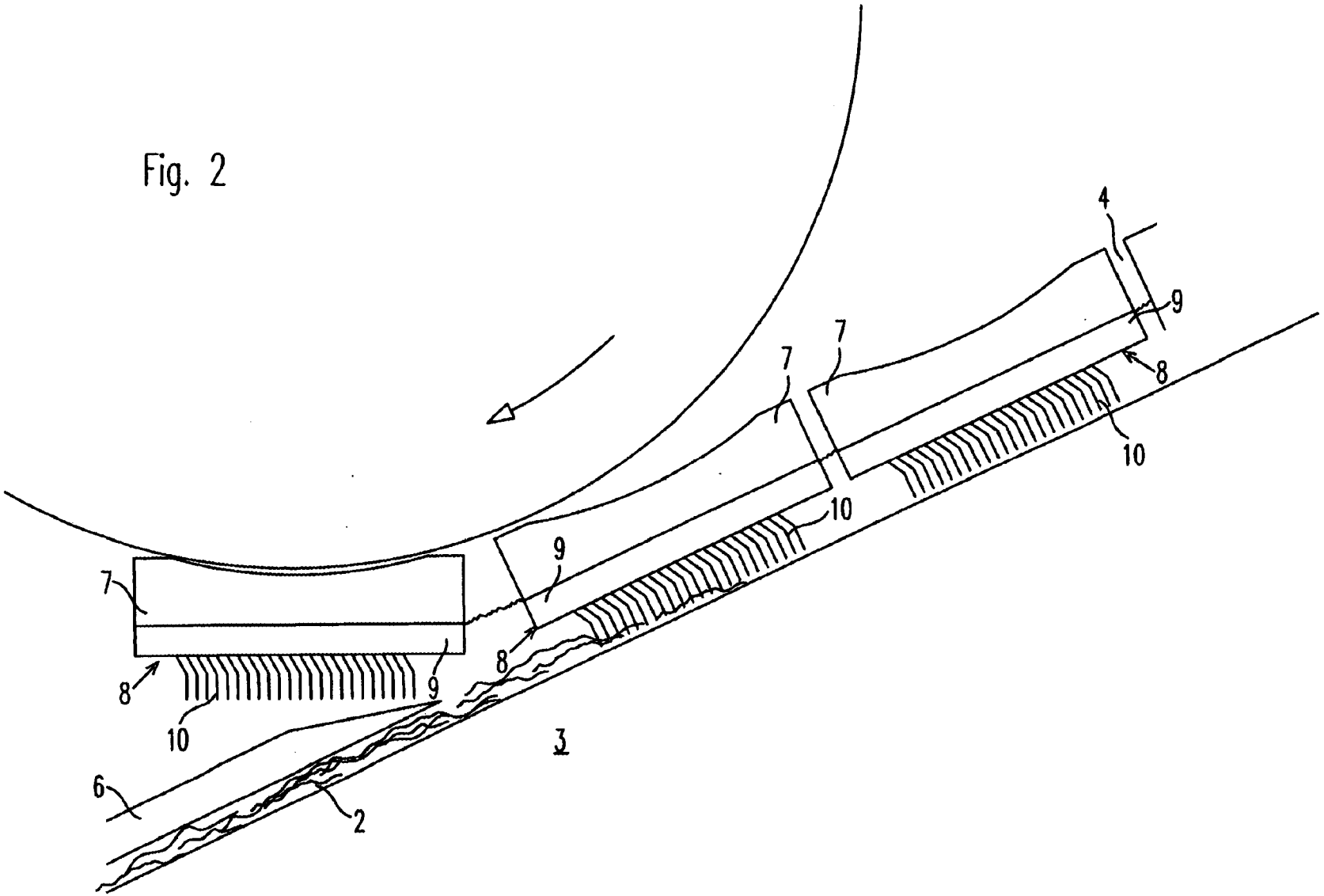
FIG. 2 is an enlarged, detailed view of a portion of the carding machine according to FIG. 1, showing clothing attached to flat bars and engaged in fibers.

The sectional detail of carding machine 1, shown in FIG. 2, shows that the fibers 2 are guided between the surface of the main carding cylinder 3 and the clothing 8 that is positioned on the fronts of flat bars 7. The flat bars 7 are positioned on the carding machine.

The flat bars 7 are arranged as traveling flat assemblies on the carding track 4, one after another and at a short distance to each other. The longitudinal axes of flat bars 7 extend in the longitudinal direction of the main carding cylinder 3.

The dimensions for clothing 8 are approximately the same as for the flat bars 7, and the clothing is composed of strip-type, elongated, fabric or cloth material layers 9 with comb structures 10 projecting from the top. The comb structures 10 are metal needle combs, which extend across nearly the complete surface of clothing 8.

The comb structures 10 engage in the fibers 2 that are guided on the main carding cylinder 3. As a result, the fibers are combed in the circumferential direction of the main carding cylinder 3 and are thus aligned parallel.

According to the invention, fastening means are provided for securing the clothing 8 to the flat bars 7, which means are reversibly detachable. Thus, these means can preferably be fastened and released repeatedly from the flat bars with the aid of simple tools.

For this, the clothing 8 is not mounted directly on the flat bars 7. Rather, the clothing 8 is secured on base supports 11. A base support 11 with clothing 8 respectively forms a dimensionally stable structural unit, which can be positioned easily and precisely on a flat bar 7.

Figure 3:
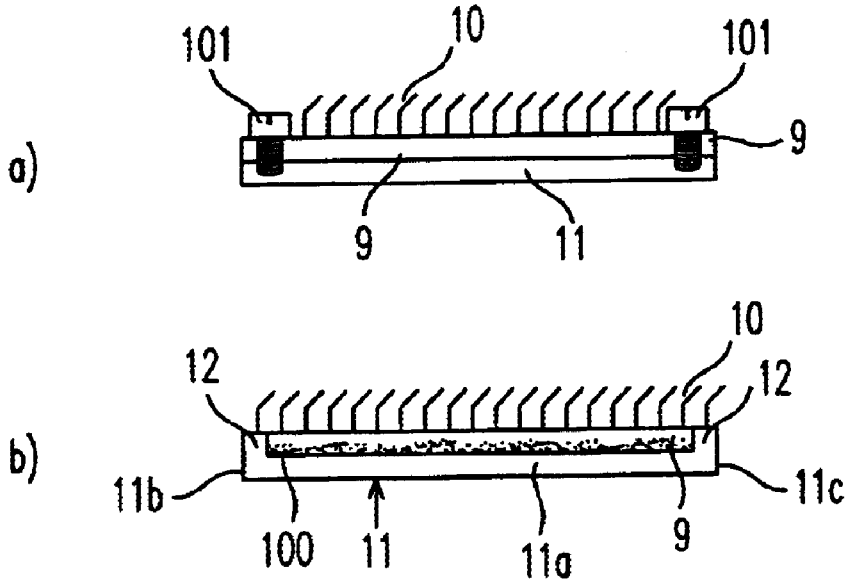
FIGS. 3*a* and 3*b* are schematic end views which show first and second exemplary embodiments, respectively, of a base support for the clothing.

FIGS. 3*a* and 3*b* show different embodiments for a base support 11 of this type, preferably consisting of sheet metal parts or thin metal profiles. In any case, the base support 11 is dimensionally stable and rigid, so that it can provide the flexible clothing 8 positioned thereon with a secure hold.

The exemplary embodiment shown in FIG. 3*a* shows a base support 11, for which the surface area is identical to the surface area of clothing 8. The base support 11 in this case has a level surface upon which the clothing 8 rests.

The base support 11 shown in FIG. 3*b* has a level surface, analog to the exemplary embodiment according to FIG. 3*a*, on which the clothing 8 rests. In addition, the base support 11 is provided along its two longitudinal edges with edge strips 12, which project from the top and secure the clothing 8 on the side. The height for edge strip 12 in this case is adjusted to the structural height of clothing 8. The edge strips 12 preferably form one piece with the base body 11*a* of base support 11.

The clothing 8 is secured to the base support 11, wherein the clothing 8 is preferably screwed on or glued to the base support.

The structural unit thus formed by securing the clothing 8 to the base support 11 is then releaseably fastened to the respective flat bar 7.

In principal, the base support 11 can be attached to the flat bar 7 by screwing 101 or gluing 100 it to the top of the flat bar.

Figure 4:
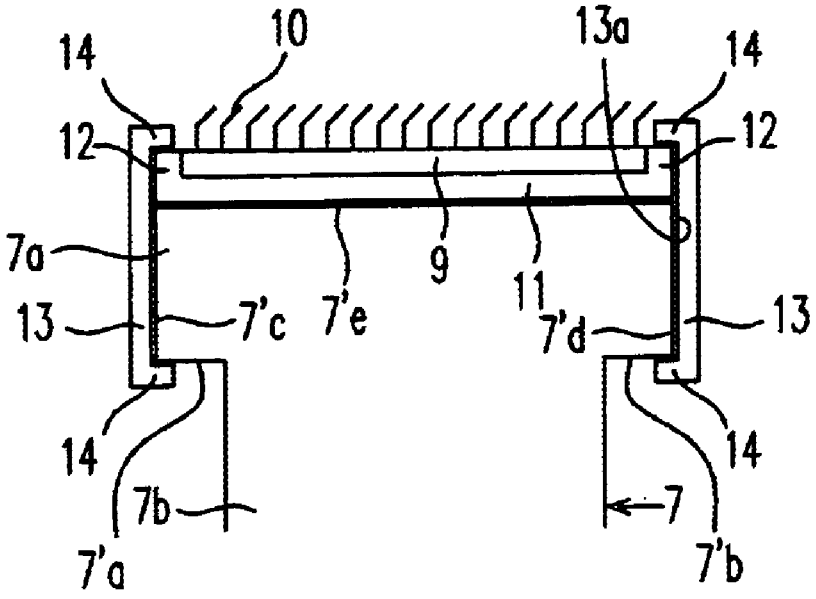
FIG. 4 is a schematic end view of a first exemplary embodiment of the fastening mechanism for fastening clothing to a flat bar.

FIG. 4 shows fastening means for securing the clothing 8 with base support 11 to a flat bar 7, thus making the assembly particularly easy, time-saving and cost-effective.

FIG. 4 shows that the flat bar 7 is provided at its upper end with a widening 7*a* in the form of a rectangular cross-sectional profile, which is followed by the narrow back end 7*b* of the flat bar 7.

As a result, the flat bar 7 has two offsets 7'*a* and 7'*b* at the lower end of the profile, which are joined by two vertically extending side walls 7'*c* and 7'*d* and the level top 7'*e* of the flat bar 7.

For the assembly, the clothing 8 together with its base support 11 is placed on the top 7'*e* of flat bar 7, wherein the side walls 11*b* and 11*c* of base support 11 end flush with the side walls 7'*c* and 7'*d* of the profile for the flat bar 7.

Brackets 13 that serve as means for fastening the flat bar 7 are snapped from the side onto the profiles. The brackets 13 consist of sheet metal parts or the like and have level support surfaces 13*a*, which fit flush against the side walls 7'*c* and 7'*d* of the profile for flat bar 7 and the base support 11 resting thereon. A projection 14 projects from the supporting surface on the top and bottom side of each bracket 13. The projection 14 on the top of bracket 13 rests against the top of base support 11, or the top of projection 12 thereof, while the projection 14 on the underside of bracket 13 fits against the profile offset 7'*a*, 7'*b* of flat bar 7. Thus, the brackets 13 secure the clothing 8 with base support 11 against being detached from the flat bar 7. The brackets 13 can preferably be snapped without tools onto the base support 11 and the flat bar 7 and can also be released from these, without the brackets 13 being destroyed in the process.

The brackets 13 of one preferred embodiment are designed as rail-type elements, wherein each bracket 13 extends over the total length of flat bar 7.

Alternatively, several individual brackets 13 can be arranged one after the other along the flat bar 7.

Figure 5:
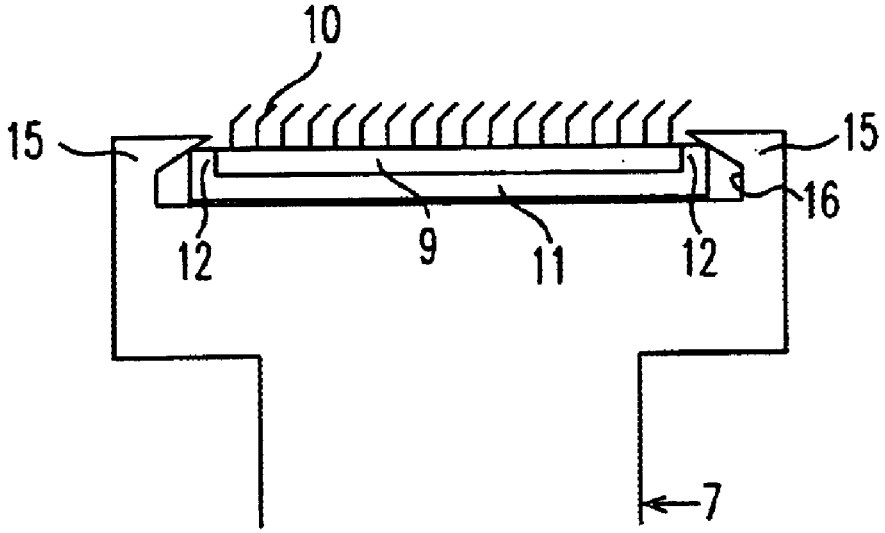
FIG. 5 is a schematic end view of a second exemplary embodiment of the fastening mechanism for fastening clothing to a flat bar.

FIG. 5 shows another embodiment of the means for securing the base support 11 with clothing 8 on the flat bar 7. In this case, the fastening means consist of a guide in the flat bar 7, wherein the guide preferably is designed as dovetail guide defining a groove 16. The dovetail guide extends in the longitudinal direction of the flat bar 7. The dovetail guide forms one piece together with the flat bar 7 and consists of two guide rails 15, which respectively stop at a longitudinal edge on the top of flat bar 7.

The heights of these guide rails 15 are adapted to the structural height of the base support 11 with clothing 8 positioned thereon.

In addition, the spacing between the guide rails 15 is adapted to the width of the base support 11 with clothing 8 positioned thereon, so that the base support 11 with clothing 8 fits tightly against the insides of the guide rails 15.

The base support 11 with clothing 8 is inserted from the front or back end of flat bar 7 into the guide opening until the base support 11 with its total length rests on the top of flat bar 7.

In order to secure the base support 11 on the flat bar 7, threaded bores that are not depicted here can be provided in the side walls of guide rails 15 and the base support 11. Screws for fastening the base support 11 to the guide rails 15 are inserted into these threaded bores.

Alternatively or in addition, the base support 11 with clothing 8 that is positioned in the guides, can be secured by closing off the end parts of the guides at the front and back end with a fastener that is not shown here. It is necessary in that case that the length of base support 11 matches exactly the length of flat bar 7, so that the base support 11 fits tightly against the front and back end between the fasteners.

The fasteners can be plates, for example, onto which the front and back sides of the flat bar 7 are screwed. End caps or the like can also be provided alternatively as fasteners, which are attached to the flat bar 7 by snapping them in.

In a modification of the exemplary embodiment according to FIG. 5, the guides and the base body for flat bar 7 can also have a multi-part design.

For example, the base body for flat bar 7 can have a level top, on which the base support 11 with clothing 8 rests. The base support 11 again extends over the complete length of flat bar 7. However, the top of flat bar 7 is wider than the width of the base support 11. The edge strips that project over the clothing 8 contain bores for fastening.

Guide rails 15 are fitted onto these edge strips in order to secure the base support 11. Screws extending through the fastening bores are used to secure the guide rails to the base body of flat bar 7.

The invention has been described in detail with respect to preferred embodiments, and it will now be apparent from the foregoing to those skilled in the art, that changes and modifications may be made without departing from the invention in its broader aspects, and the invention, therefore, as defined in the appended claims, is intended to cover all such changes and modifications that fall within the true spirit of the invention.

What is claimed is:

1. An arrangement for a carding machine for parallel arrangement of fibers, comprising:

a carding track;

a plurality of flat bars arranged for being guided along the carding track;

clothing positioned respectively on each flat bar, the clothing including strips of flexible material layers having comb structures for engaging the fibers;

means for releaseably fastening the clothing to each flat bar; and a rigid base support secured to each clothing, wherein each clothing secured to a rigid base is releaseably fastened to a respective one of the flat bars; and wherein each flat bar has a top and side walls, the clothing with attached base support rests on the top of the flat bar, and the releaseable fastening means comprises brackets each of which fit against a respective side wall of the flat bar and the base support.

2. The carding machine according to claim 1, wherein the base support comprises a sheet metal piece.

3. The carding machine according to claim 2, wherein the clothing is one of screwed and glued to the sheet metal piece.

4. The carding machine according to claim 1, wherein the base support has side edges with edge strips projecting therefrom for securing the clothing at a side of the clothing.

5. The carding machine according to claim 4, wherein the base support and edge strips comprise a one piece sheet metal part.

6. The carding machine according to claim 1, wherein each bracket has a front wall that fits against one of side walls of the flat bar, each bracket has an upper side including a projection extending at about 90° from the upper side and a lower side including a projection extending at about 90° from the lower side, one of the projections fitting against an upper side of the base support or the clothing and the other projection fitting against an offset of the flat bar.

7. The carding machine according to claim 1, wherein each bracket extends over a total length of the flat bar or clothing arranged thereon.

8. The carding machine according to claim 1, wherein the fastening means comprises a plurality of brackets arranged one after another in a longitudinal direction of the flat bar and the clothing arranged thereon.

9. The carding machine according to claim 1, wherein the brackets each comprise a sheet metal part.

10. The carding machine according to claim 1, wherein the releasable fastening means comprises a glue connection for releaseably fastening the base support with the clothing arranged thereon to the flat bar.

11. The carding machine according to claim 1, wherein each flat bar includes a guide for receiving a respective one of the base supports with the clothing arranged thereon.

12. The carding machine according to claim 11, wherein the guide of the flat bar comprises a dove-tail guide.

13. The carding machine according to claim 11, wherein the base support with clothing arranged thereon is insertable into the guide.

14. The carding machine according to claim 1, wherein the clothing includes material layers of fabric.

15. The carding machine according to claim 1, wherein the clothing includes material layers of cloth.

16. The carding machine according to claim 1, wherein the means for releaseably fastening the clothing to each flat bar includes means for reversibly fastening the releaseably fastening means to the flat bar.

17. The carding machine according to claim 1, wherein the releaseably fastening means is adapted so as not to be damaged upon fastening and releasing the clothing to the flat bar.

18. The carding machine according to claim 1, wherein the releaseably fastening means are not bent upon fastening and releasing the clothing from the flat bar.

19. The carding machine according to claim 1, wherein the releaseably fastening means do not include a screw.

* * * * *